United States Patent [19]

Luers

[11] Patent Number: 4,700,777

[45] Date of Patent: Oct. 20, 1987

[54] GRAVEL PACKING APPARATUS AND METHOD

[75] Inventor: Thomas J. Luers, Thornton, Colo.

[73] Assignee: Halliburton Company, Duncan, Okla.

[21] Appl. No.: 850,473

[22] Filed: Apr. 10, 1986

[51] Int. Cl.[4] ..... E21B 34/12; E21B 43/04

[52] U.S. Cl. ..... 166/185; 166/51; 166/205; 166/278

[58] Field of Search ..... 166/278, 31 Z, 51, 101, 166/185, 205, 334

[56] References Cited

U.S. PATENT DOCUMENTS

| | | | |
|---|---|---|---|
| 3,072,204 | 1/1963 | Brown | 175/230 |
| 3,421,586 | 1/1969 | Solum | 166/51 |
| 3,627,046 | 12/1971 | Miller et al. | 166/278 |
| 3,726,343 | 4/1973 | Davis, Jr. | 166/278 |
| 3,901,318 | 8/1975 | Fortenberry | 166/278 |
| 3,913,676 | 10/1975 | Barbee, Jr. et al. | 166/278 |
| 3,963,076 | 6/1976 | Winslow | 166/278 |
| 3,987,854 | 10/1976 | Callihan et al. | 166/278 |
| 4,018,284 | 4/1977 | Perkins | 166/278 |
| 4,253,522 | 3/1981 | Setterberg, Jr. | 166/278 |
| 4,372,384 | 2/1983 | Kinney | 166/278 |
| 4,541,484 | 9/1905 | Salerni et al. | 166/334 X |

OTHER PUBLICATIONS

Halliburton Services Catalog No. 41, p. 4009, EZ Drill SV Squeeze Packer; p. 4012, EZ Drill SV Squeeze Packer; p. 4009, EZ Drill Bridge Plug.

*Primary Examiner*—George A. Suchfield

*Attorney, Agent, or Firm*—James R. Duzan; Neal R. Kennedy

[57] ABSTRACT

An apparatus for placing a filter screen and for packing gravel around the filter screen adjacent a well formation. The apparatus includes a body having a packer portion and a valve portion. The body defines a central passageway therethrough. The valve portion includes a valve mandrel with a valve sleeve slidably positioned therein, and transverse openings in the valve sleeve and valve mandrel are aligned to form a transverse passageway therethrough when the valve is in an open position. A stinger is positionable in the body for closing the central passageway and actuating the valve sleeve between the open and closed positions thereof. When in the open position, the transverse openings in the valve mandrel and valve sleeve are aligned with a transverse opening in the stinger such that fluid communication is provided between a well annulus below the packer portion and the tool string above the apparatus. Collet fingers engage the stinger so that when the stinger is moved from the body, the valve is closed. The stinger has seal members thereon, and the stinger may be positioned such that the transverse opening therein is above the packer portion while at least one seal element is still sealingly engaged with the central passageway. In this way, fluid communication is provided between the tool string and a well annulus above the packer. When the stinger is removed from the body, the central passageway is opened for production of fluids therethrough. A method for using the apparatus is also disclosed.

6 Claims, 8 Drawing Figures

GRAVEL PACKING APPARATUS AND METHOD

BACKGROUND OF THE INVENTION

1. Field Of The Invention

This invention relates to apparatus used for placing a filter screen adjacent a well formation for gravel packing around the screen, and more particularly, to a gravel packing apparatus having a valve actuated by a stinger for pumping gravel through a tubing string into a well annulus adjacent the filter screen, and further allowing recirculation above the apparatus and production through the apparatus.

2. Description Of The Prior Art

Most gravel packing operations utilize a retrievable packer having means for pumping gravel therethrough to a well annulus around a filter screen positioned below the packer. These retrievable packers are relatively complex and the procedure of setting and unsetting is lengthy and expensive. The time and cost associated with such packers is a particular problem with low fluid level, marginal wells. The present invention solves this problem by providing a less expensive gravel packing apparatus which is made more simple to operate. The packer of the present invention includes an open central passageway therethrough so that the packer may be left in the well bore and production fluids simply flowed through it after the gravel packing operation. A stinger is used to temporarily close the central passageway and actuate a valve for pumping the gravel. The stinger is also used to close the valve and allow reverse circulation above the packer while maintaining the central passageway closed.

Another problem with prior packing operations using retrievable packers is that residual pressure in the well formation may blow out the gravel pack before a production packer or liner seal can be installed. The present invention solves this problem since the packer remains in place.

The gravel packing apparatus of the present invention is a modification of the EZ Drill SV® squeeze packer manufactured by Halliburton Services and disclosed in Halliburton Services Catalog No. 41, page 4009. The EZ Drill SV® squeeze packer is used for cementing operations and does not have a central passageway therethrough. This previous packer is actuated by a setting tool having a central opening therethrough. The EZ Drill SV® squeeze packer is not usable for a gravel packing operation as is the present invention.

Because the valve in the present invention may be opened and closed as desired, and because the packer remains in the well bore, remedial gravel packing around the filter screen is easily accomplished by running the stinger back in the hole. Running in another packer and going through the steps of operating it are avoided. Also, the present invention is unlike previous apparatus which include valve systems which cannot be reactuated. Finally, the apparatus of the present invention may be employed to place a screen, without subsequent gravel packing, adjacent a formation susceptible to breakdown during production, to prevent formation fines and other debris from obstructing and clogging tubing, pumps, valves and other production equipment.

SUMMARY OF THE INVENTION

The apparatus of the present invention comprises a body including packer means attachable to a first, upper tool string portion, including a packer setting tool of a kind known in the art, for packing off a portion of a well bore and valve means adjacent the packer means. The valve means is attachable to a second, lower tool string portion which is generally characterized by a filter screen. The valve means has an open position defining transverse passageway means therethrough and a closed position.

The apparatus further comprises central passageway means for providing fluid communication through the body when the valve means is in the closed position. Additionally, the apparatus comprises stinger means attachable to the packer setting tool for positioning in the body for closure of the central passageway means, for alternately actuating the valve means between the open and closed positions, and for providing fluid communication between the tool string and a well annulus below the packer means when the central passageway means is closed and the valve means is in the open position.

Preferably, the stinger means further includes means for providing fluid communication between the tool string and a well annulus above the packer means when the central passageway means is closed and the valve means is in the closed position.

In the preferred embodiment, the valve means comprises a valve mandrel defining a central opening therethrough and a valve sleeve slidingly disposed in the central opening. The valve sleeve also defines a central opening therethrough which is in communication with the central opening of the valve mandrel, and the valve sleeve further defines a transverse opening therein. The transverse passageway means is characterized by alignment of the transverse opening in the valve mandrel with the transverse opening in the valve sleeve.

The stinger means comprises a stinger having an open end which is attachable to the packer setting tool and a closed end which is selectively positionable in at least one of the central openings of the valve sleeve and the valve mandrel for sealing closure thereof. The stinger is further engageable with the valve sleeve for selective longitudinal displacement of the valve sleeve, corresponding to the closed and open positions of the valve means.

A shoulder in the body provides means for limiting maximum longitudinal displacement of the valve sleeve.

The stinger also defines a transverse opening therethrough which is aligned with the transverse openings of both the valve mandrel and the valve sleeve when the valve means is opened, such that the tool string is in fluid communication with the well annulus below the packer means. Seal means are disposed on the stinger on opposite sides of the transverse opening through the stinger.

A seal positioned on the stinger also provides means sealingly closing the central opening of the body when the stinger is in a position in which the transverse opening in the stinger is in fluid communication with the annulus above the packer.

The valve means includes collet means for holding the valve sleeve in the closed position. The collet means are forced into the central opening of the valve mandrel when the valve sleeve is displaced to the open position, and the collet fingers are thus in a position for engagement with the stinger when the stinger is moved for reverse displacement of the valve sleeve.

Seal means in operative association with the valve means and the stinger means are provided for preventing fluid communication between the transverse passageway means and the second tool string portion.

The packer means preferably comprises a non-retrievable packer for semi-permanent location in the well bore. The packer includes a packer mandrel with a packing mechanism thereon which is actuated in a manner known in the art by the setting tool.

The present invention also includes a method of positioning a filter screen in a well bore and of packing gravel around the filter screen in a well bore. The positioning method comprises the steps of positioning a gravel packer body with a normally open central passageway and a normally closed transverse passageway therein as part of a tool string, attaching the filter screen below the gravel packer body as another part of the tool string, positioning a stinger in the gravel packer body for closing the central passageway and opening the transverse passageway, running the tool string into the well bore for positioning the screen adjacent a desired well formation, setting a packer mechanism on the gravel packer body into engagement with the well bore at a position above the well formation and opening the central passageway for producing through the screen and central passageway in the packer. If it is desired to gravel pack, the method further comprises, after setting the packer mechanism, pumping gravel through the transverse passageway into a well annulus below the gravel packer body, packing the gravel adjacent the filter screen in the well annulus, closing the transverse passageway, and circulating fluid in a reverse direction above the gravel packer body before opening the central passageway. The method may further comprise the step of washing out the well annulus between the tool string and well bore above the packer after positioning the screen, but prior to setting the packer.

The step of positioning a stinger in the gravel packer body for closing the central passageway and opening the transverse passageway preferably comprises sealingly closing the central passageway with a closed end of the stinger and actuating a longitudinally sliding valve in the gravel packer body to an open position for forming a fluid connection between the tool string and the well annulus below the packer.

The steps of closing the transverse passageway and circulating fluid preferably comprise longitudinally sliding the valve to a closed position, raising the stinger to a position in which a portion thereof is maintained in contact with the gravel packer body for continued sealing closure of the central passageway while providing fluid communication between the tool string and a well annulus above the gravel packer body, and pumping fluid down the well annulus through the stinger and up the tool string.

The step of opening the central passageway is accomplished by removing the stinger from the gravel packer body.

A remedial gravel packing operation may be accomplished by repeating the steps of closing the central passageway and opening the transverse passageway, pumping the gravel, closing the transverse passageway, and circulating fluid in a reverse direction.

An important object of the present invention is to provide a gravel packing apparatus which remains in a well bore after a gravel packing operation and allows production fluids to flow therethrough.

Another object of the invention is to provide a gravel packing apparatus with a valve therein for packing gravel around a filter screen while sealingly enclosing a central opening through the valve to prevent gravel entering the filter screen.

An additional object of the invention is to provide a packer which utilizes a stinger to sealingly close a central opening therethrough while providing means for reverse circulation above the packer.

Still another object of the invention is to provide a gravel packing apparatus which may be reused for remedial packing operations.

A further object of the invention is to provide a method of packing gravel around a filter screen and provide production through a gravel packer left in the well bore.

Yet another object of the invention is to provide an apparatus and method of placing a filter screen in a well bore adjacent a producing formation.

Further objects and advantages of the invention will become apparent as the following detailed description of the preferred embodiment is read in conjunction with the accompanying drawings which illustrate such preferred embodiment.

DESCRIPTION OF THE PREFERRED EMBODIMENT

Figure 1A:
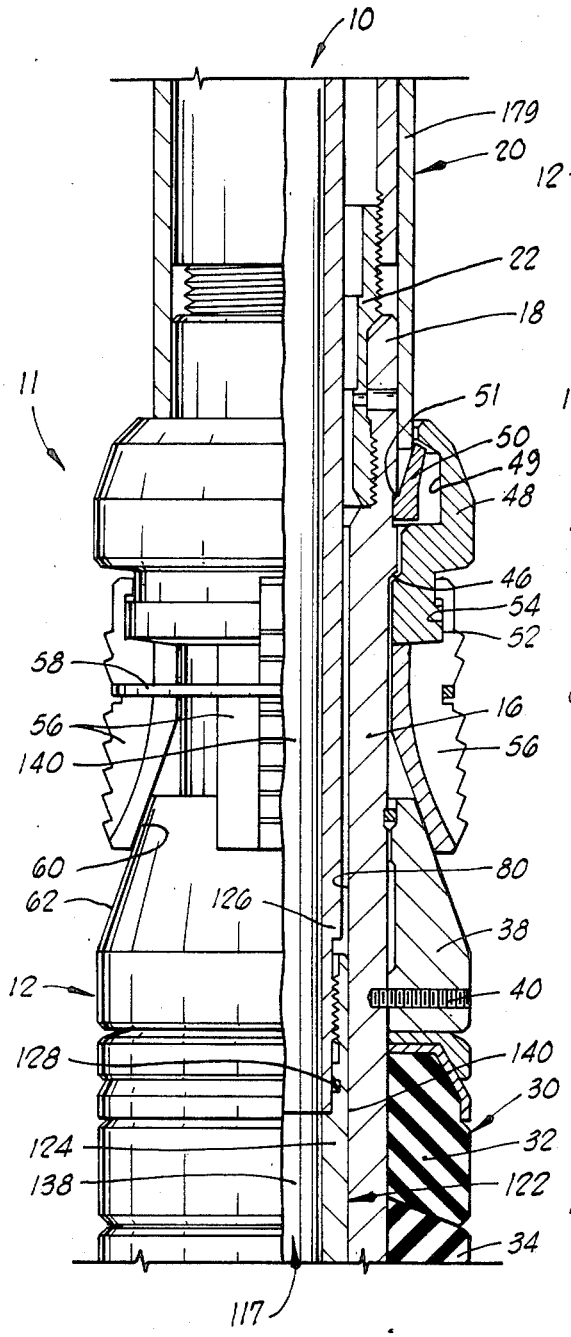
FIGS. 1A–1D shows a longitudinal cross section of the gravel packing apparatus of the present invention.
Figure 1B:
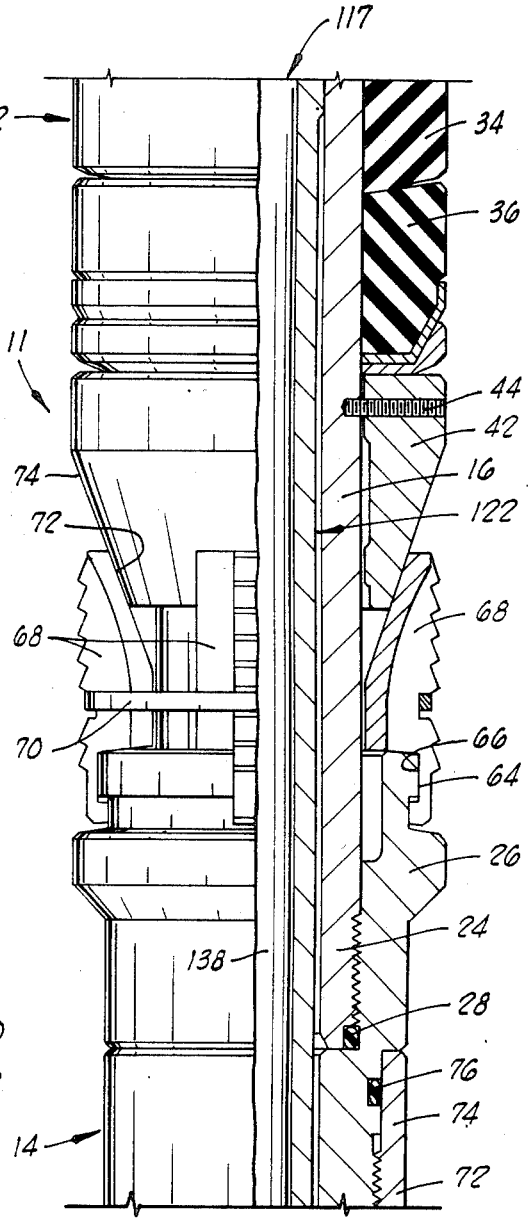

Referring now to the drawings, and particularly FIGS. 1A–1D, the gravel packing apparatus of the present invention is shown and generally designated by the numeral 10. A major component of gravel packing apparatus 10 is a body portion 11 which includes an upper packer portion 12 and a lower valve portion 14 adjacent the packer portion.

Packer portion 12 includes a packer mandrel 16 having an upper end 18 connected to a packer setting tool 20 of a kind known in the art by a tension sleeve 22. Packer setting tool 20 forms a part of a tool string above packer portion 12. Packer mandrel 16 has a lower end 24 threadingly engaged with a lower slip support 26. An O-ring 28 is provided for sealing between packer mandrel 16 and lower slip support 26.

Positioned around packer mandrel 16 is a packer mechanism 30 which includes resilient packer elements 32, 34 and 36. Packer element 32 is attached to a slidable upper packer end 38 which is longitudinally held in place on packer mandrel 16 by shear pin 40. Similarly, packer element 36 is attached to lower packer end 42 which is longitudinally positioned on packer mandrel 16 by shear pin 44.

Positioned above upper packer end 38 and adjacent shoulder 46 on packer mandrel 16 is an upper slip support 48. Upper slip support defines an annular cavity 49 therein. Positioned in cavity 49 and adjacent packer mandrel 16 is a lock ring 50 having an inner shoulder 51 thereon.

Upper slip support 48 has an outwardly directed flange 52 which is engaged with corresponding notches 54 in a plurality of upper slips 56. Slips 56 are in turn held in place by a retainer ring 58. Each slip 56 has a tapered inner surface 60 in contact with conical surface 62 of upper packer end 38.

In a similar manner, lower slip support 26 has an outwardly directed flange 64 engaged with notches 66 in a plurality of lower slips 68. Slips 68 are held in place by a retainer ring 70, and each slip 68 has a tapered internal surface 72 in contact with conical surface 74 on lower packer end 42.

A valve mandrel 72 has an upper end 74 threadingly engaged with lower slip support 26 and sealed therewith by an O-ring 76. Valve mandrel 72 defines a central opening 78 therethrough which is in communication with central opening 80 in packer mandrel 16. Central opening 78 has a substantially constant diameter intermediate portion 82 which is preferably the same diameter as central opening 80 in packer mandrel 16. At least one transverse opening 84 extends through valve mandrel 72 in communication with intermediate portion 82 of central opening 78. A pair of seal cavities 88 extend radially outwardly from intermediate portion 82, and each seal cavity contains a sealing element 88, such as an O-ring.

A chamfered shoulder 90 extends radially outwardly from intermediate portion 82 of central opening 78 to a substantially constant diameter upper portion 92 of the central opening. A lower shoulder 94 extends radially inwardly from intermediate portion 82 to a smaller diameter lower portion 96 of central opening 78.

Valve mandrel 72 has an externally threaded lower end 98 for attachment to a lower tool string portion as hereinafter described.

Slidingly disposed in central opening 78 of valve mandrel 72 is a valve sleeve 100. Valve sleeve 100 has an outside surface 102 dimensioned to closely fit within intermediate portion 82 of central opening 78 of valve mandrel 72. Extending upwardly from valve sleeve 100, and forming an integral part thereof, are a plurality of collet fingers 104. Collet fingers 104 are outwardly biased to extend into upper portion 92 of central opening 78 in valve mandrel 72. Each collet finger 104 includes an outer shoulder 106 adapted for engagement with shoulder 90. Each collet finger 104 also has an inner shoulder 108.

Valve sleeve 100 defines a central opening 110 therethrough having a substantially constant diameter portion 112. A shoulder 114 extends to a small diameter portion 116 of central opening 110. It will be seen that central opening 110, central opening 78 in valve mandrel 72, and central opening 80 in packer mandrel 16 form a normally open central passageway 117 through body 11.

At least one transverse opening 118 extends through valve sleeve 100. An annular, chamfered recess 120 is located in central opening 110 adjacent transverse opening 118.

Another major component of gravel packing apparatus 10 is stinger 122. Stinger 122 has an open upper end formed by a collar 124 which is preferably threadingly engaged with a tube 126 attached to packer setting tool 20 and which is in communication with the tool string. An O-ring 128 is used to seal between collar 124 and tube 126. The lower end of collar 124 is threadingly engaged with stinger body 130 with an O-ring 132 sealing therebetween. Stinger body 130 is threadingly engaged with plug 134 which forms a closed lower end of stinger 122. Another O-ring 136 seals between stinger body 130 and plug 134.

It will be seen that collar 124 and stinger body 130 define a central opening 138 of substantially constant diameter in stinger 122. Central opening 138 is in communication at its upper end with central opening 140 in tube 126, and is closed at its lower end by plug portion 134.

The outer surface of stinger 122 has an enlarged upper portion 140 formed on collar 124 and is dimensioned to closely fit into, and guide with, central opening 80 of packer mandrel 16. An enlarged intermediate portion 142 of stinger 122 is formed on collar 124 and body 130, and is adapted to closely fit within constant diameter portion 122 of central opening 110 in valve sleeve 100. An annular seal cavity 144 is defined in enlarged portion 142, and a sealing element 146 is disposed in the seal cavity for sealing engagement between valve sleeve 100 and stinger 122. An enlarged lower portion 148 of stinger 122 is formed on body 130 and plug 134, and is also dimensioned for close spaced relationship with constant diameter portion 112 of central opening 110 in valve sleeve 100 and central opening 80 in packer mandrel 16. A seal cavity 150 is formed in enlarged portion 148. A seal element 152 is disposed in seal cavity 150 for sealing between stinger 122 and valve sleeve 100 or packer mandrel 16 as hereinafter described.

At least one transverse opening 154 extends through body 130 of stinger 122. It will be seen that seal elements 146 and 152 are located opposite sides of transverse opening 154. An annular, chamfered recess 156 is defined in the outer surface of body 30 adjacent transverse opening 154.

OPERATION OF THE INVENTION

Referring now also to FIGS. 2A–2B and 3A–3B, gravel packing apparatus 10 is shown in an operating position within a well bore 158 defined by a well casing 160. In the preferred embodiment, a filter screen 162 is attached to lower end 98 of valve mandrel 72 by means of a collar 164. Thus, filter screen 162 forms a lower portion of the entire tool string and is in fluid communication with central passageway 117.

Stinger 122 is inserted into body 11 until the stinger reaches the position shown in FIGS. 1A–1D in which lower chamfered shoulder 176 on plug 134 contacts shoulder 114 in valve sleeve 100. As already indicated, the diameter of central opening 80 in packer mandrel 16 is preferably the same as constant diameter portion 112 of central opening 110 in valve sleeve 100. Thus, as soon as seal element 152 is inserted into packer mandrel 16, central passageway 117 is sealingly closed. It will be seen that when stinger 122 is in the position shown in FIGS. 1A–1D, transverse opening 154 in the stinger is aligned with transverse opening 118 in valve sleeve 100.

Figure 2A:
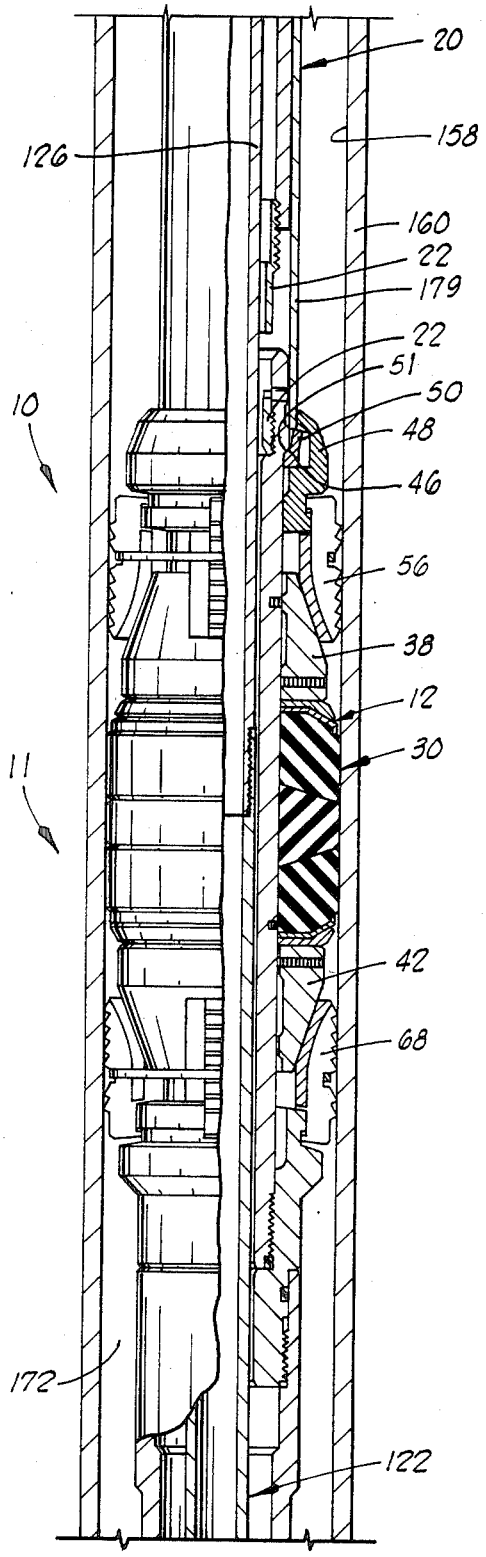
FIGS. 2A–2B show the apparatus in a well bore in a position for packing gravel around a filter screen.
Figure 2B:
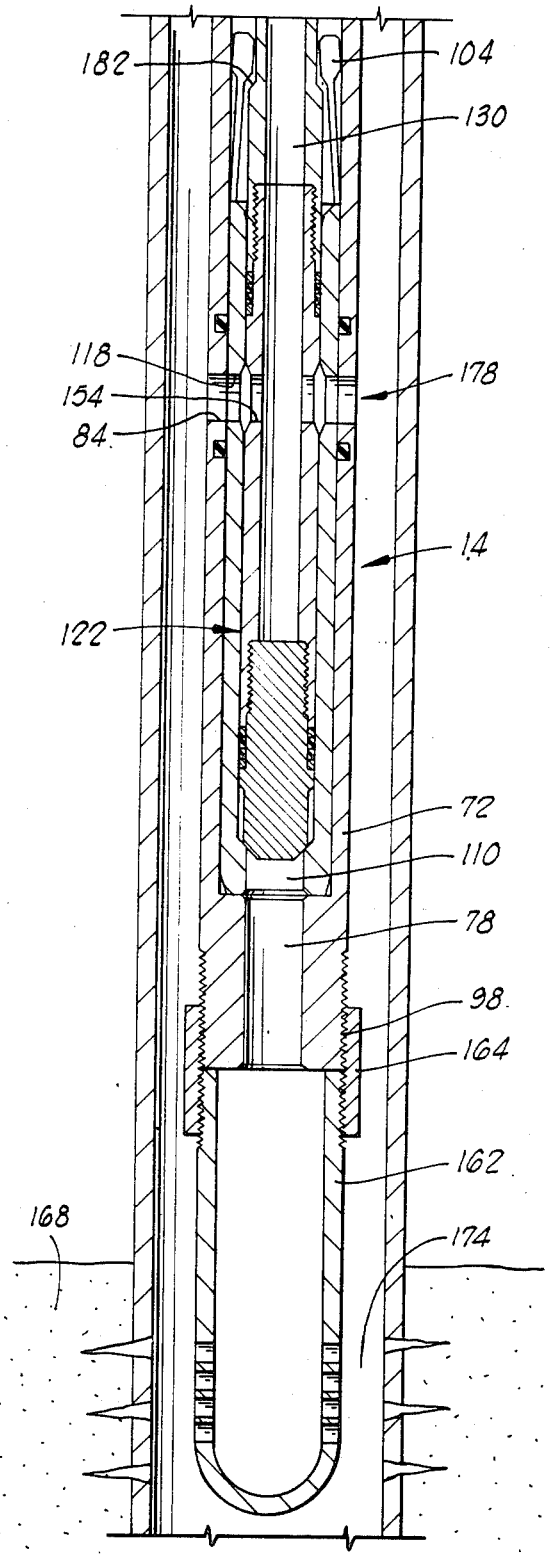

As stinger 122 is further inserted into body 11, valve sleeve 100 is actuated to the transversely open position shown in FIGS. 2A–2B in which transverse opening 154 in stinger 122 and transverse opening 118 in valve sleeve 100 are both aligned with transverse opening 84 in valve mandrel 72. Thus, a transverse passageway 178 is defined through body 11.

Tension sleeve 22 is attached to setting tool 20 at the lower end of the tool string and the apparatus is lowered into the well to the position shown in FIGS. 2A–2B. Prior to setting packer portion 12, fluid may be circulated to wash out the well annulus between the packer and the well bore by flowing through transverse passageway 178. This circulation may be in either direction.

Using a manner known in the art, a setting sleeve 179 on setting tool 20 is brought into engagement with lock ring 50. Packer mandrel 16 is pulled upwardly by setting tool 20 while lock ring 50 is expanded by setting sleeve 179. During the setting operation, upper slips 56 and lower slips 68 are engaged with well bore 158. Also, shear pins 40 and 44 are sheared so that upper packer end 38 and lower packer end 42 are moved together to outwardly force packer elements 32, 34 and 36 into engagement with well bore 158. After setting, shoulder 51 on lock ring 50 is adjacent and below shoulder 46 on packer mandrel 16.

Also, during the setting operation, tension sleeve 22 breaks so that packer portion 12 is free from setting tool 20, and it will be clear to those skilled in the art that the packer will remain in its set position. If the screen 162 has been placed adjacent a formation to act as a filter, without subsequent gravel packing, stinger 122 is withdrawn from apparatus 10 and the well may be produced in a manner hereinafter described.

However, if gravel packing is to be effected, the apparatus is in the configuration shown in FIGS. 2A–2B, valve portion 14 is in the transversely open position, and the central passageway in body 11 is closed. It will be seen that fluid communication is provided between well annulus 172 below packer portion 12 and central opening 138 in stinger 122. Thus, gravel slurry may be pumped down the tubing string into central opening 138 in stinger 122, and through transverse passageway 178 into well annulus 172 to pack and squeeze gravel in annular volume 174 around filter screen 162.

As valve sleeve 100 is moved downwardly by stinger 122 to the open position thereof, collet fingers 104 are forced inwardly so that the outer surface 180 thereof engages intermediate portion 82 of central opening 78 in valve mandrel 72. This inward deflection of collet fingers 104 results in shoulder 108 thereof being located adjacent and above shoulder 182 on stinger 122.

Figure 1C:
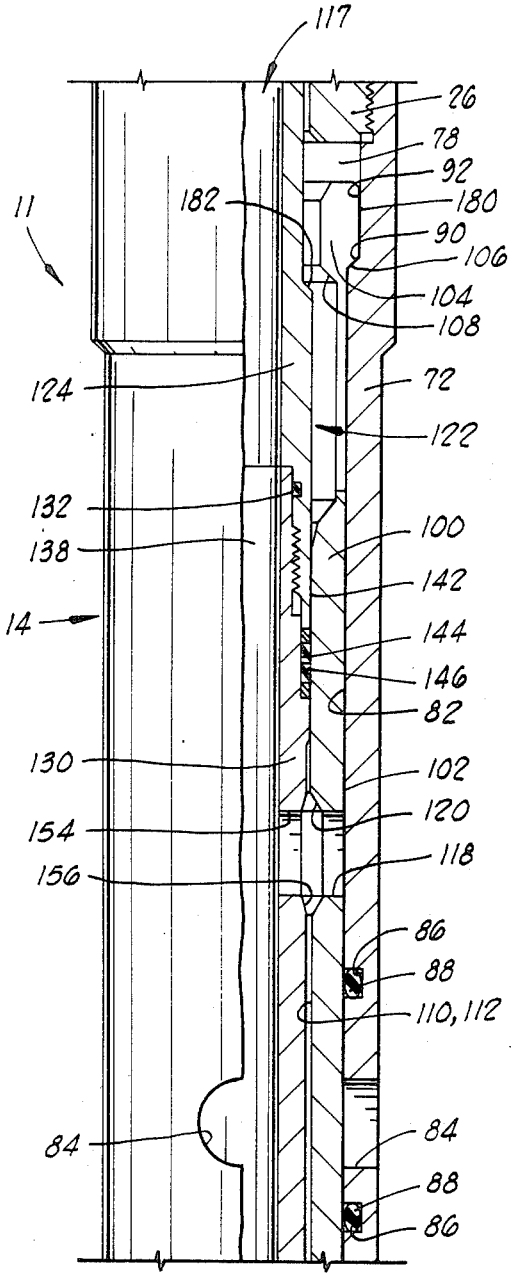
Figure 1D:
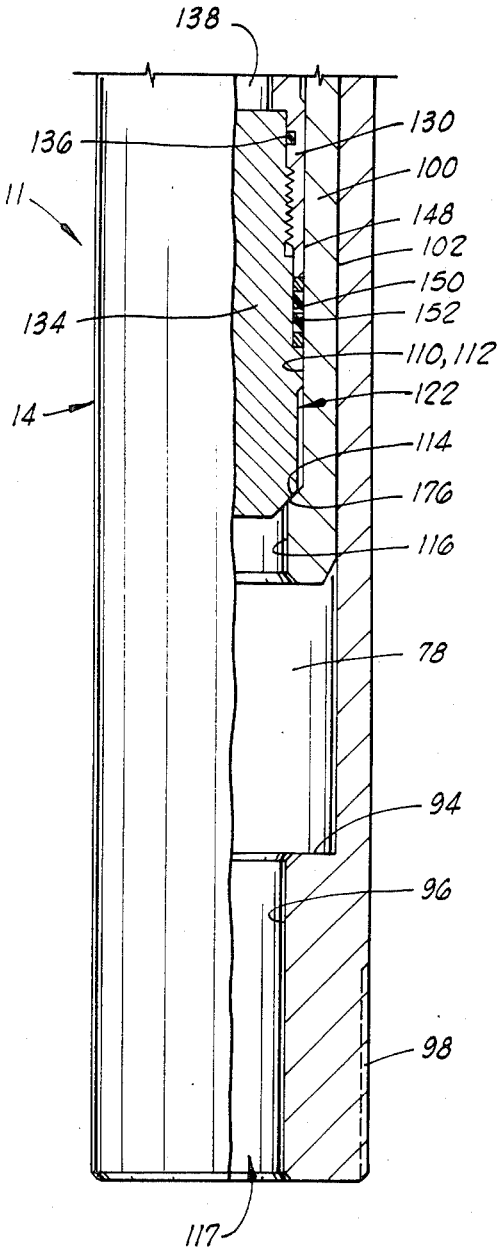

After the gravel packing and squeezing operation has been carried out, stinger 122 is raised by lifting tubing string 126. It will be seen that shoulder 182 on stinger 122 contacts shoulder 108 on collet fingers 104 so that valve sleeve 100 is raised upwardly until shoulder 106 on the collet fingers is aligned with shoulder 90 on valve mandrel 72, at which point the outwardly biased collet fingers return to their original position, as best shown in FIG. 1C. Thus, stinger 122 provides a means for longitudinally sliding valve sleeve 100 both downwardly and uwardly, and thus provides a means of transversely opening and closing valve portion 12. After collet fingers 104 return to their original position, stinger 122 is thus freed therefrom and may be moved further upwardly.

Figure 3A:
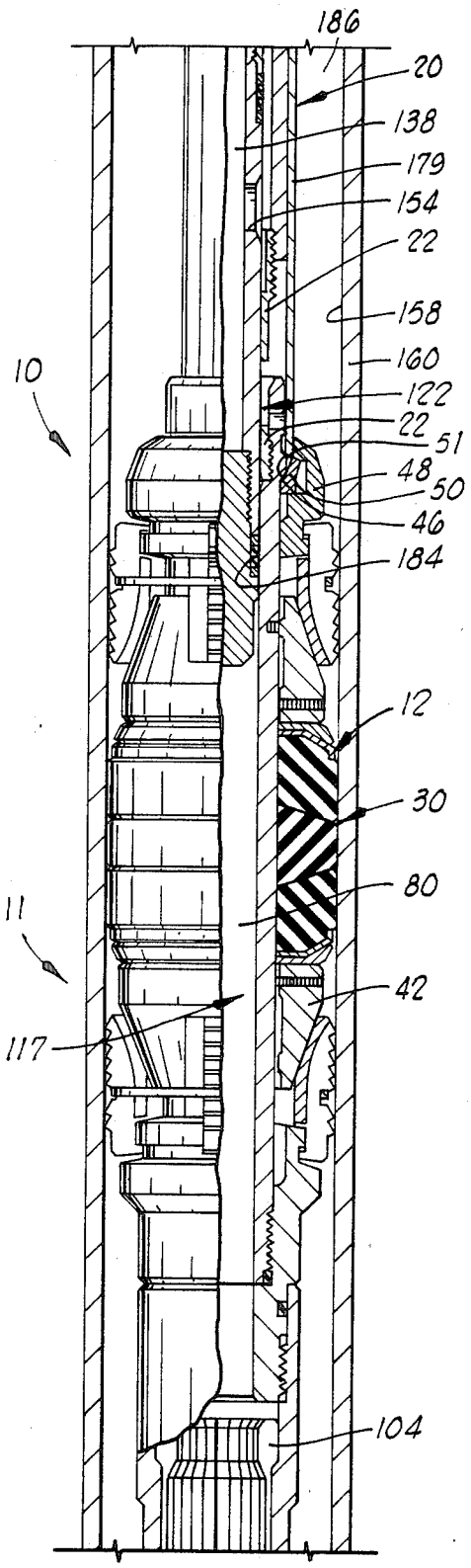
FIGS. 3A–3B illustrate a cross section of the apparatus in a well bore in a position for recirculating fluids above the packer.
Figure 3B:
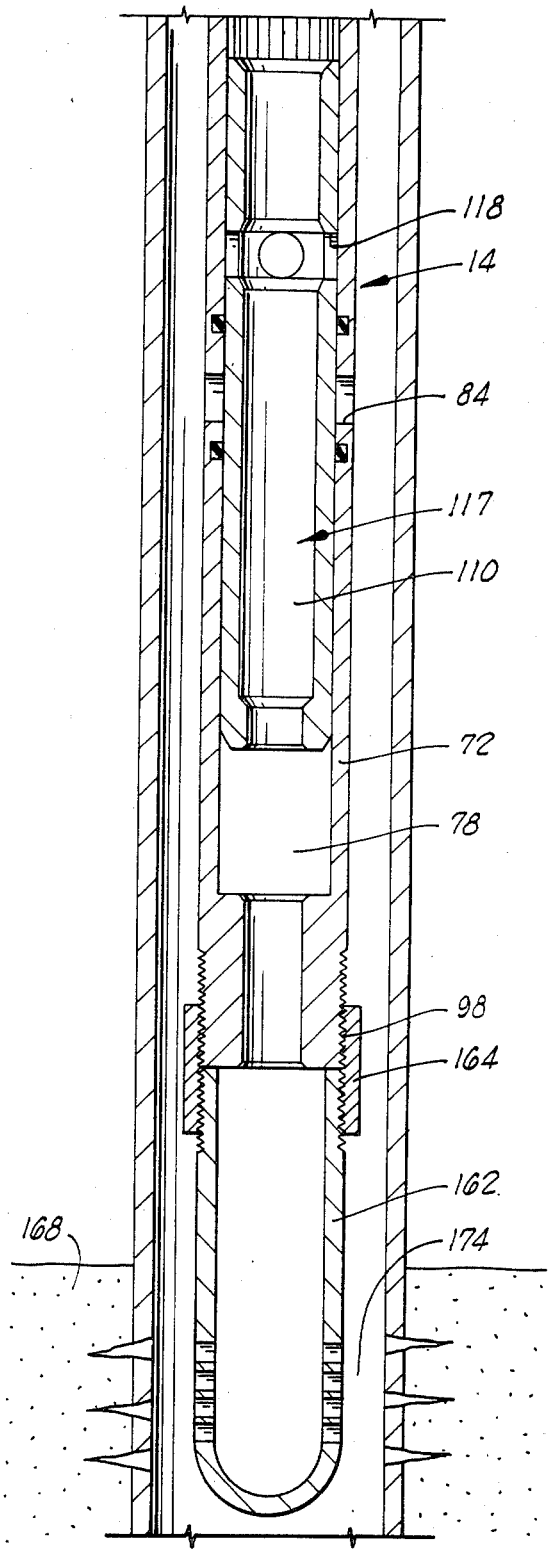

Stinger 122 is next raised to the position illustrated in FIGS. 3A–3B in which transverse openings 154 therein are above connector 22 of packer portion 12, but lower sealing element 152 on the stinger is still in sealing contact with an upper portion 184 of central opening 80 of packer mandrel 16. In this way, central passageway 117 remains sealed and closed. However, transverse opening 154 in stinger 122 now provides fluid communication between central opening 138 in the stinger and a well annulus 186 above packer portion 12. By reverse circulation, fluid may be pumped downwardly through annulus 186, through transverse opening 154 into central opening 138 in stinger 122 to clean out central opening 138 and central opening 140 in the tool string without exposing the formation to the circulating fluids or pressures. In a similar manner, circulation can be effected without risk of contact with the formation. After this reverse circulation, cleaning operation is completed, the tool string including stinger 122 may be removed from the well, which reopens the central passageway 117. It should be noted that when stinger 122 is removed, pressure in the formation from the squeeze-type gravel pack will be relieved through filter screen 162, which, unlike prior art squeeze packs, does not tend to disturb the pack.

Production equipment is installed in the well, and production fluid in formation 168 is free to flow through the gravel pack into filter screen 162, through central passageway 117 and upwardly to the well surface. Production may be effected in several different ways. For example, production tubing with a seal nipple at the bottom may be stabbed into central opening 80 in apparatus 10 and the well produced. Alternatively, a production packer may be set above apparatus 10 at the end of production tubing, and the well produced. Yet another possibility, if the well will not flow, is to place a tubing anchor at the bottom of tubing above apparatus 10 and produce the well using a pump jack, as is well known in the art.

Remedial packing is easily carried out by reinserting stinger 122 into body 11 and repeating the steps hereinbefore described.

It can be seen, therefore, that the gravel packing apparatus and method of use of the present invention are well adapted to carry out the objects and attain the ends and advantages mentioned, as well as those inherent therein. While a presently preferred embodiment of the invention has been described for the purpose of this disclosure, numerous changes in the construction and arrangement of parts in the apparatus can be made by those skilled in the art. All such changes are encompassed within the scope and spirit of this invention as defined by the appended claims.

What is claimed is:

1. A downhole tool comprising:

packer means connected to a first tool string portion thereabove for packing off a portion of a well bore;

valve means adjacent and secured to said packer means and connected to a second tool string portion therebelow, said valve means having an open position defining transverse passageway means extending between the interior and exterior of said valve means and a closed position;

central passageway means extending longitudinally through said packer means and valve means for providing fluid communication between said first and second tool string portions; and tubular stinger means extending downwardly from said first tool string portion into said central passageway for closure thereof, for engaging said valve means and longitudinally displacing same between said open and closed positions, and for providing fluid communication between said first tool string portion and a well annulus below said packer means when said central passageway means is closed by the lower end of said stinger below said valve means, and said valve means is in said open position.

2. The apparatus of claim 1 wherein said stinger means further includes means for providing fluid communication between said first tool string portion and a well annulus above said packer means when said central passageway means is closed above said valve means by the lower end of said stinger means and said valve means is in said closed position.

3. The apparatus of claim 1 wherein:

said valve means comprises:

a mandrel defining a central opening therethrough and having a transverse opening in the wall thereof; and a valve sleeve slidingly disposed in said central opening of said mandrel, said valve sleeve defining a central opening therethrough in communication with said central opening of said mandrel and further defining a transverse opening therein, said transverse passageway means being characterized by alignment of said transverse opening in said mandrel and said transverse opening in said valve sleeve; and said stinger means comprises a stinger having an open end attachable to said first tool string portion and a closed end, said closed end being selectively positionable in at least one of said central openings of said valve sleeve and said mandrel for sealing closure thereof.

4. The apparatus of claim 3 wherein said valve means further comprises collet means for holding said valve sleeve in said closed position, said collet means being forced into said central opening of said mandrel when said valve sleeve is displaced downwardly to said valve means open position by engagement with said stinger, said inwardly forced collet means engaging said stinger whereby subsequent upward movement of said stinger will displace said valve sleeve upwardly to said valve means closed position, whereat said collet means will disengage said stinger means.

5. The apparatus of claim 1 further comprising seal means on said stinger means for preventing fluid communication between said transverse passageway means and said second tool string portion when the lower end of said stinger means is positionaed below said valve means.

6. The apparatus of claim 1 wherein said packer means comprises a compression-set non-retrievable packer for semi-permanent location in said well bore.

* * * * *